US006018888A

United States Patent [19]

Wilkenfeld et al.

[11] Patent Number: 6,018,888

[45] Date of Patent: Feb. 1, 2000

[54] PROTECTIVE FOOTWEAR FOR MODERN DANCE

[76] Inventors: David Wilkenfeld, 3895 Corsair St., Suite A, Rono, Nev. 89502; Patricia Barker, 2528 First Ave. West, Seattle, Wash. 98119

[21] Appl. No.: 09/055,631

[22] Filed: Apr. 6, 1998

[51] Int. Cl.[7] ..... A43B 5/12

[52] U.S. Cl. ..... 36/8.3; 36/113; 36/73

[58] Field of Search ..... 36/8.3, 113, 96, 36/73, 7.4, 11.5, 15

[56] References Cited

U.S. PATENT DOCUMENTS 1,754,054 4/1930 Selva .
1,872,641 8/1932 Capezio .
2,544,270 3/1951 L'Hollier .
4,069,599 1/1978 Alegria .
4,277,897 7/1981 O'Connell .
4,495,715 1/1985 Fredrickson et al. .
4,535,554 8/1985 De Obaldia .
5,247,741 9/1993 Pastor .
5,257,969 11/1993 Mance .

*Primary Examiner*—Ted Kavanaugh
*Attorney, Agent, or Firm*—Handal & Morofsky

[57] ABSTRACT

An item of footwear which functions as a foot protector for dancers is disclosed. The inventive protector comprises a pad. The pad has its periphery at least partially surrounded by an elastic member. A plurality of other elastic members secure to the pad to the underside of a dancer's foot, in particular the ball of the dancer's foot. In accordance with a preferred embodiment, that portion of the periphery of the pad which is likely to be position over that portion of the ball of the foot on which the dancer rotates and/or slides is left without elastic in order to minimize discomfort which would be caused by the presence of a piece of elastic material.

8 Claims, 8 Drawing Sheets

PROTECTIVE FOOTWEAR FOR MODERN DANCE

FIELD OF THE INVENTION

The present invention relates to an item of protective footwear particularly suited for ballet and modem dance, generally.

BACKGROUND

It has been suggested that dancing is the oldest of the art forms. Certainly, it has been found in every culture and on every continent in the world since time immemorial. In all instances, the elements of rhythm, symmetry, repetition, exaggeration and grace exhibit themselves in a visual spectacle that both enlists attention, and instills a feeling of well-being both in participants and the audience. While in the simplest forms of dance, these elements of rhythm, symmetry, a repetition, exaggeration and grace all are incorporated in movement of the hands and feet, the torso also tends to follow movements and participate in the exercise.

In more developed forms of dance, such as the minuet, square dancing, and in the dancing of the Middle Ages generally, the torso is an active participant in the dance, with its movement controlled into orientation and position to complement the movement of the hands and feet. It all of these forms of dance, however, movement is made with a relatively natural and ordinary energy expenditure, as well as with movements which derived from everyday un-stressed movements.

However, with the development of the dance, and desire for a greater range of artistic expression, dancers have catapulted themselves from the ordinary everyday sorts of movements to movements derived from actions at the edge of human endurance and athletic ability. Perhaps one of the more refined forms of dance first to employ such movements was the ballet.

In ballet, movements include dance steps inspired by running, jumping, leaping and physical interaction between two or more individuals. The end result is a remarkably punishing regimen of movement being associated with virtually any ballet performance. Not surprisingly, the pursuit of perfection in ballet goes along with a remarkably high incidence of strain and injury. Indeed, the problem is so serious that few dancers are able to practice their profession into middle age.

At the same time, the attempt, in ballet, to achieve extremes in movement has spawned the development of footwear adapted to enable such unnatural movements as rotation on a toe, walking and landing on the toes, and the like. Such footwear, in addition to enabling such dance steps, also has the salutary effect of protecting the feet, by spreading out the force of a landing, or the pressure resulting from support of the body over a wide area of the outside surface of the foot, thus reducing the incidence of injury and strain. However, footwear also has the effect of reducing control under certain circumstances.

Moreover, while the use of, for example, ballet slippers provides a visually stimulating display, given the slipper's typically satiny silk charmeuse finish, in many forms of dance, the visibility of the shoe is regarded with disfavor. This is articulate cell indicates of modern dance where the "barefoot "look is considered, for many pieces, required.

Moreover, given the fact that modern dance builds upon classical ballet and thus takes from classical ballet dramatic movements at the edge of human endurance and ability, the attempt to implement this measure of control and exaggeration without protective footwear has been disastrous in terms of the impact on the modern dancer. Nevertheless, so vigorous is the requirement for dancing without the protection of the classical ballet slipper, dancers, daily, subject their feet to the punishment of impacts, pulls, twisting and abrasion. The result is sore, inflamed skin, or, worse, cracked and bleeding soles.

SUMMARY OF THE INVENTION

The present invention is directed to an unobtrusive foot covering that protects the ball of a dancer's foot. It accommodates the desire of modern dancers to wear no shoes while performing or practicing their dance routines. At the same time, it allows dancing barefoot without causing the dancers to sustain injuries to what would otherwise be their uncovered feet. In particular, the ball of the dancers foot is protected from injury.

The above objects of the invention are achieved by the use of a protective pad which is positioned on the inventive footwear in such a matter as to result in its being placed over the ball of the foot when the footwear is in position on a human foot. The protective pad is made of a material which, on the side which faces the sole or ball of the foot, have a coefficient of friction which securely engages the ball before at all points. This results in spreading out the force of what would otherwise be an abrasive impact over a wide area of the ball of the foot. While it is true that there is still a pulling of the flesh in the area surrounding point of engagement with the pad, because of the large area of engagement, even the pull is spread over a wider portion of skin, thus reducing the likelihood of injury.

The side of the pad which faces the floor has a coefficient of friction which is high enough to provide secure engagement of the floor by the ball of the foot, and yet low enough to allow the ball of the foot to rotate or slide on a typically polished dance floor. In accordance with the preferred embodiment, the coefficient of fiction of the pad surface facing the ball of the foot is higher than the coefficient of friction between the pad and the polished dance floor.

The pad is maintained in position by a plurality of elastic straps which fit around the toes, heel and metatarsus of the dancer's foot.

In addition and in accordance with the preferred embodiment, an elastic member comprising an elastic ribbon of material with a textile-like finish such as ordinary elastic band of the type used in sewing, is used to form the edge of the pad. This edge material also has the salutary effect, in combination with the elastic straps which secure the pad of the inventive item of footwear to the toes, in step and heel, of allowing the pad to be formed around the ball of the foot.

BRIEF DESCRIPTION OF THE DRAWINGS

One way of carrying out the invention is described in detail below with reference to drawings which illustrate only to specific embodiments of the invention.

DETAILED DESCRIPTION OF THE PREFERRED EMBODIMENTS

Figure 1:
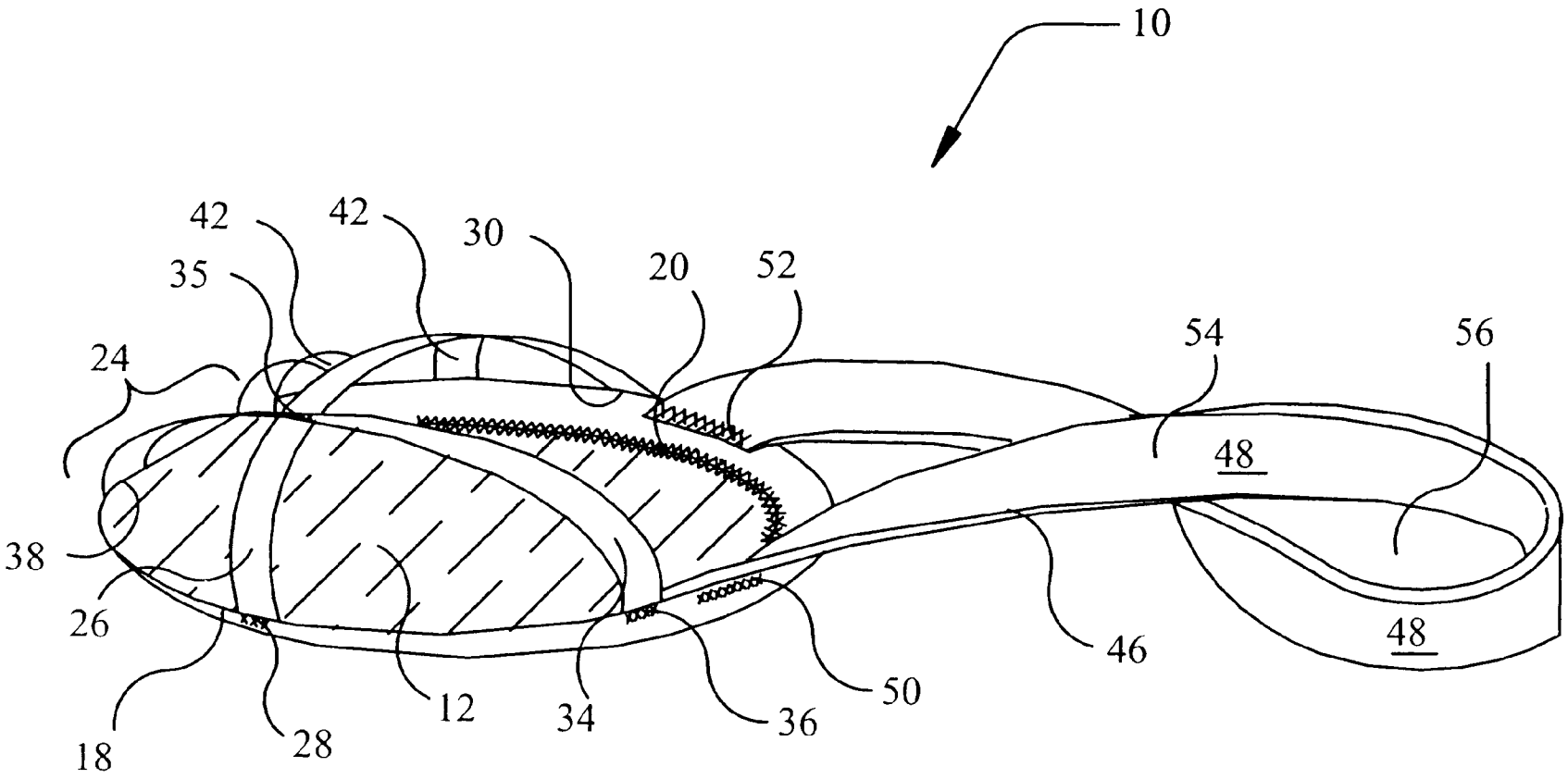
FIG. 1 is a side perspective view of the present invention.
Figure 2:
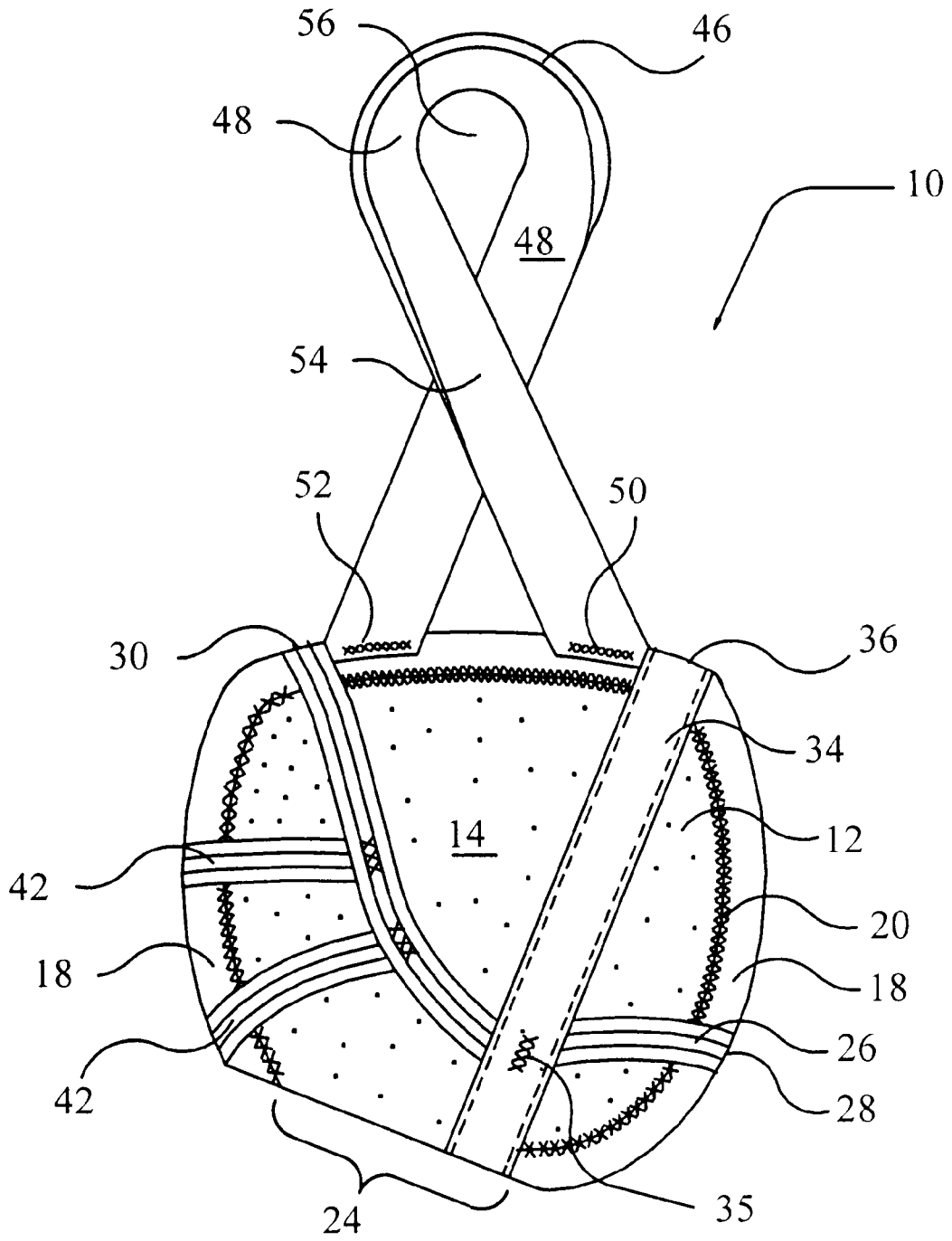
FIG. 2 is a top plane view of the FIG. 1 embodiment.
Figure 3:
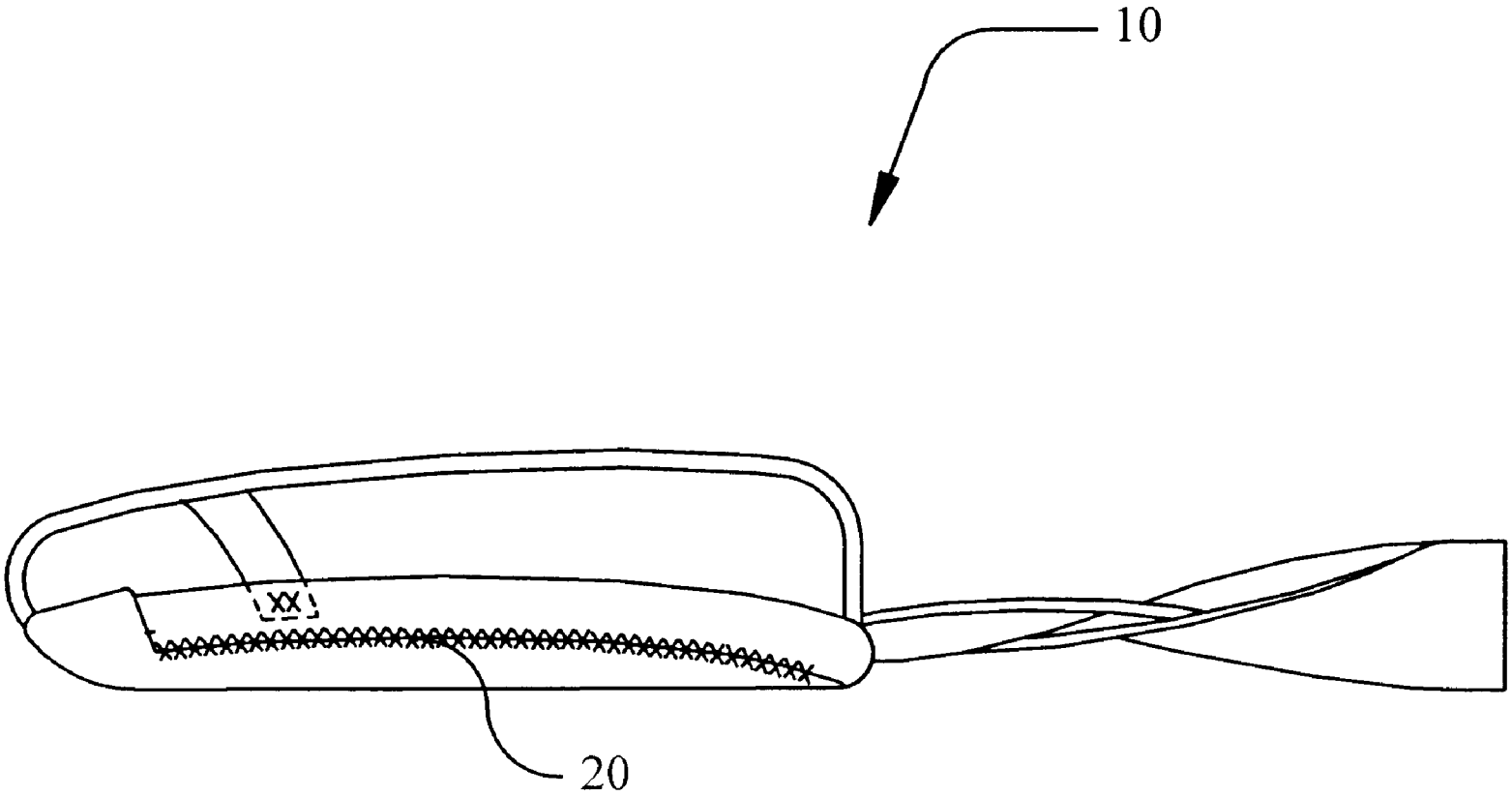
FIG. 3 is a side view illustrating the present invention.
Figure 4:
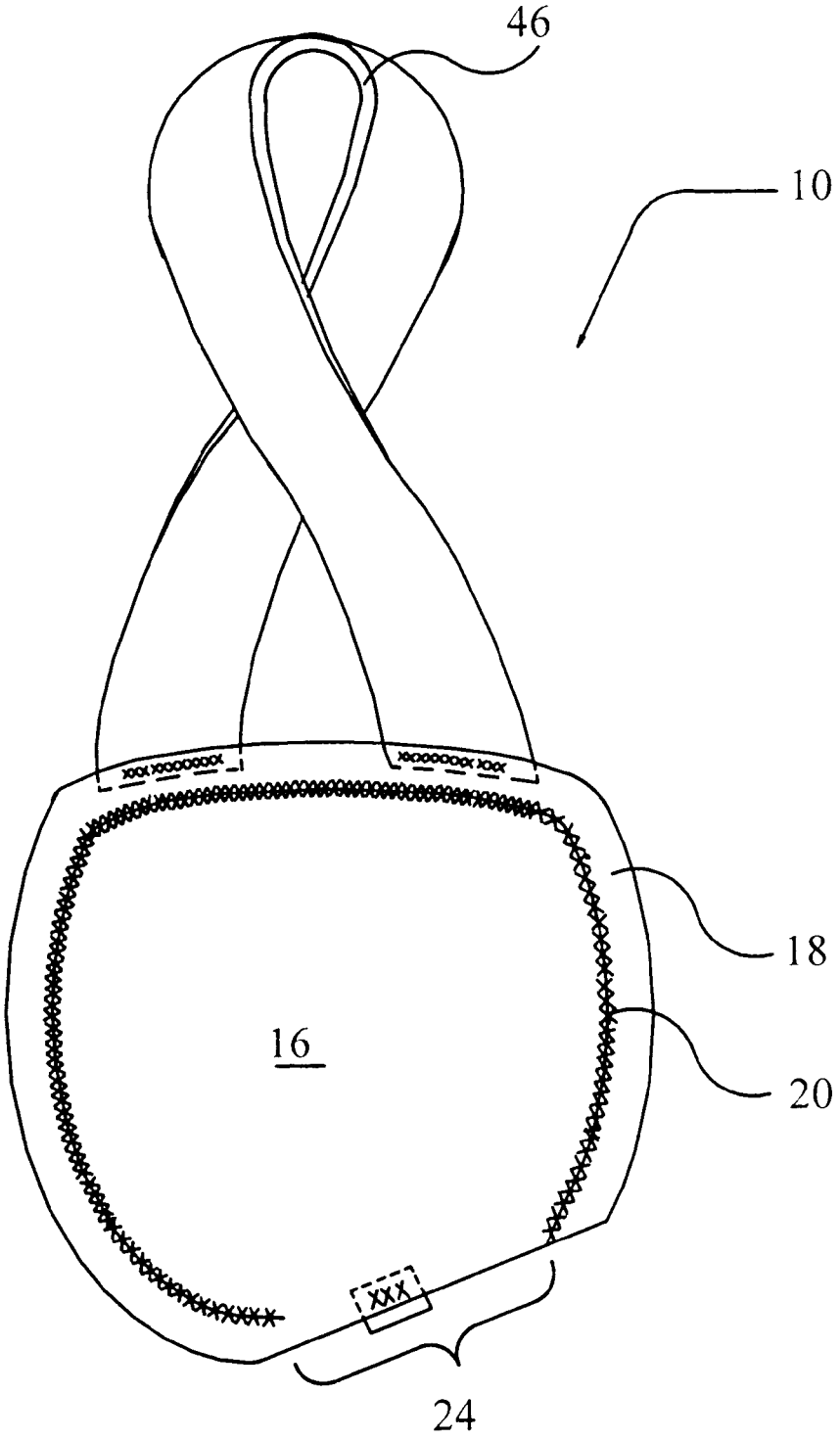
FIG. 4 is a bottom view of the present invention.

Referring now to FIGS. 1–4, protective foot covering 10 constructed in accordance with the present invention is shown. Foot covering 10 has a protective sole 12. In accordance with the present invention protective sole 12 has an oval shape configured to cover be ball portion of the dancers foot. Alternatively, protective sole 12 can be elliptical or circular in shape. In yet another embodiment protective sole 12 can be cut to match the ball of the dancers foot.

Protective sole 12 is cut from a lightweight yet durable leather such as cowhide, generally referred to as chrome tanned cowhide split. This type of cowhide is used for its ability to breath, comfort (ie. softness) and to absorb sweat or moisture. Protective sole 12 has an upper surface 14 and a lower surface 16. Upper surface 14 makes contact with the ball of a dancers foot while lower service 16 makes contact with the dance floor.

Lower surface 16 generally has a rougher texture to it than upper surface 14. This feature provides comfort to the dancer's foot while providing a rougher surface for making contact with the dance floor.

In addition, the coefficient of friction of lower surface 16 is greater than the coefficient of friction of upper surface 14.

Protective sole 12 has handle elastic band 18 attached along the periphery of protective sole 12. Elastic band 18 is sewn to upper surface 14 through a plurality of stitches 20. Stitches 20 are made by a thread 22. In the preferred embodiment thread 22 is cotton, such as cotton #120.

As illustrated, stitches 20 are sewn in a zig zag pattern to maintain protective sole 12 and elastic band 18 a configuration which ensures that the edge of protective sole 12 remain flat with elastic band 18.

Elastic band 18 almost completely encloses the periphery of protective sole 12 leaving only a portion 24 uncovered by elastic band 18. Portion 24 is located at the front portion of foot covering 10. Portion 24 is of a sufficient size to accommodate the smaller toes of the dancers foot.

Moreover, elastic band 18 is sewn to the periphery of protective sole 12 in such a manner to define an exterior side wall along the periphery of protective sole 12. Elastic band 18 is sewn to the periphery of protective sole 12 to maintain elastic band 18 in an upright position, which helps define the side walls of the foot covering 10. Elastic band 18 comprises an elastic material being fairly soft for comfort purposes and having sufficient recovery characteristics after being stretched.

In the preferred embodiment elastic band 18 is configured to stretch in directions substantially parallel to protective sole 12.

An elastic strap 26 is attached to elastic band 18 at one end defining a first point 28 and is attached to elastic band 18 at its other end and defining a second point 30.

Figure 5:
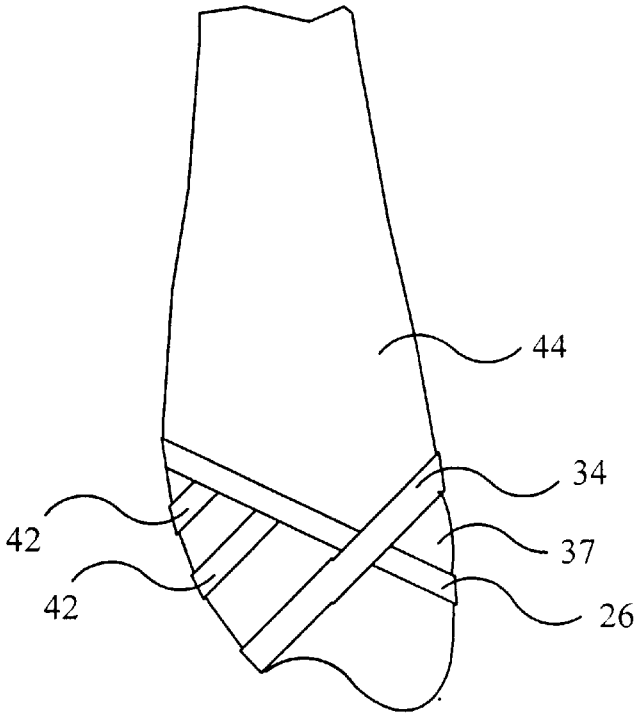
FIG. 5 is side perspective view of the present invention being worn around the foot of a dancer.
Figure 6:
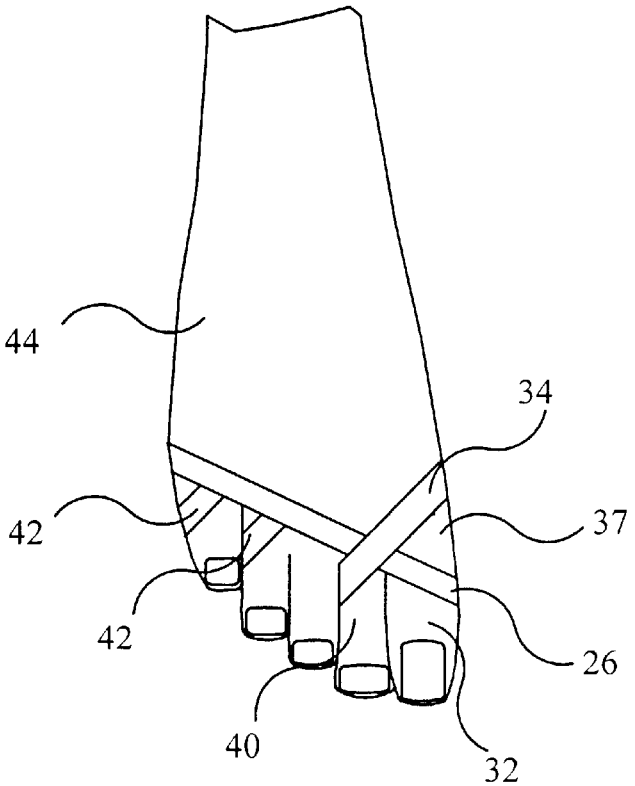
FIG. 6 is a top plane view of the present invention on an individual's foot.
Figure 7:
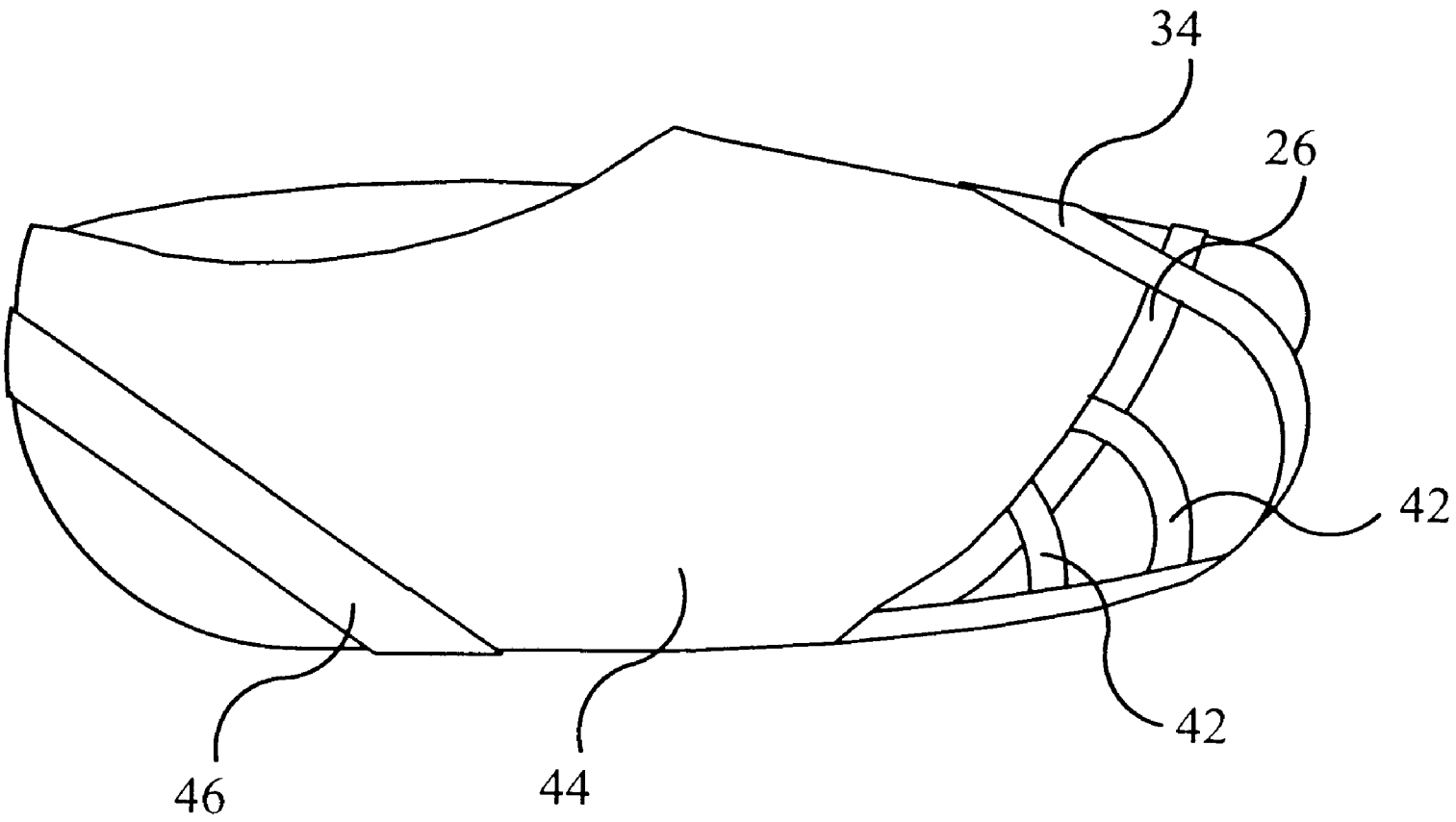
FIG. 7 is a side view of the present invention on an individual's foot.

First point 28 is located at a position along elastic band 18 which would be positioned along the side of the dancers big toe 32 (as illustrated in FIGS. 5–7).

Turning back now to FIGS. 1–4, a second elastic strap 34 is secured at one end to elastic band 18 defining a contact point 36 and its other end is secured to protective sole 12 defining a second contact point 38. Second contact point 38 is positioned to align second elastic strap 34 with toe 40 of a dancer (as illustrated in FIGS. 5 and 6).

In addition contact points 28 and 36 are positioned to accommodate for the bunion (*Hallus Vulgus*) 37 of the dancer's foot.

Second elastic strap 34 is of a larger gage than strap 26. Second elastic strap 34 is secured to elastic strap 26 at an intersecting point 35.

A pair of lateral supporting elastic bands 42 are connected to elastic band 26 and elastic band 18. Lateral supporting elastic bands 42 are positioned to provide support to be side wall of protective foot covering 10 defined by elastic band 18. In addition, lateral supporting bands 42 also wrap around a portion 44 of the dancer's foot (as illustrated in FIGS. 5–7). Portion 44 is generally referred to as the metatarsus of an individual's foot.

Elastic strap 26, second elastic strap 34 and lateral supporting bands 42 each maintain sole portion 12 in a closely fitted position wherein sole portion 12 provides a protective covering the ball of a dancers foot.

Elastic bands 42 are of a thickness small enough to fit comfortably in between the toes of a dancer.

A heel strap 46 is secured to elastic band 18 along the rear portion of sole portion 12. In the preferred embodiment heel strap 46 is secured to elastic band 18 using a polyester/cotton core spun #50 thread. This thread is used primarily for its strength.

Heel strap 46 is comprised from a neoprene type material which also has an elastic covering 48 adhered to either side of heel strap 46. The neoprene has a soft spongy texture for comfort and to frictionally engage the heel of a dancer.

Elastic covering 48 allows for heel strap 46 to have an elasticity which allows a dancer to stretch heel strap 46 a sufficient amount to place protective foot covering 10 over the ball of their foot and heel strap 46 around their heel.

One end of heel strap 46 is secured to elastic band and 18 at a first point 50 and the other end use secured to elastic band 18 at second point 52. Heel strap 46 is secured by a plurality of stitches sewn through heel strap 46 and elastic band 18.

The securement of heel strap 46 to elastic band 18 is conducted in such a manner so as to cause heel strap 46 to be crossed over itself at a point 54 and define a receiving area 56.

Referring now to FIGS. 5–8, as a user or dancer puts protective foot covering 10 on their foot heel strap 46 is stretched to enlarge receiving area 56 to a point where the heel of the dancer can be received.

This configuration prevents heel strap 46 from interfering with the line of vision of the foot.

Dance is also an aesthetic art, particularly classical dance where a primary focus of this aesthetic is that the feet are and extension of the limbs. Therefore, the stronger the dancer's arch and therefore the more they can point their foot, the better the aesthetic line. Thus, the crossover of heel strap 46 prevents strap 46 from interfering with the line of vision of the dancer's foot.

Figure 8:
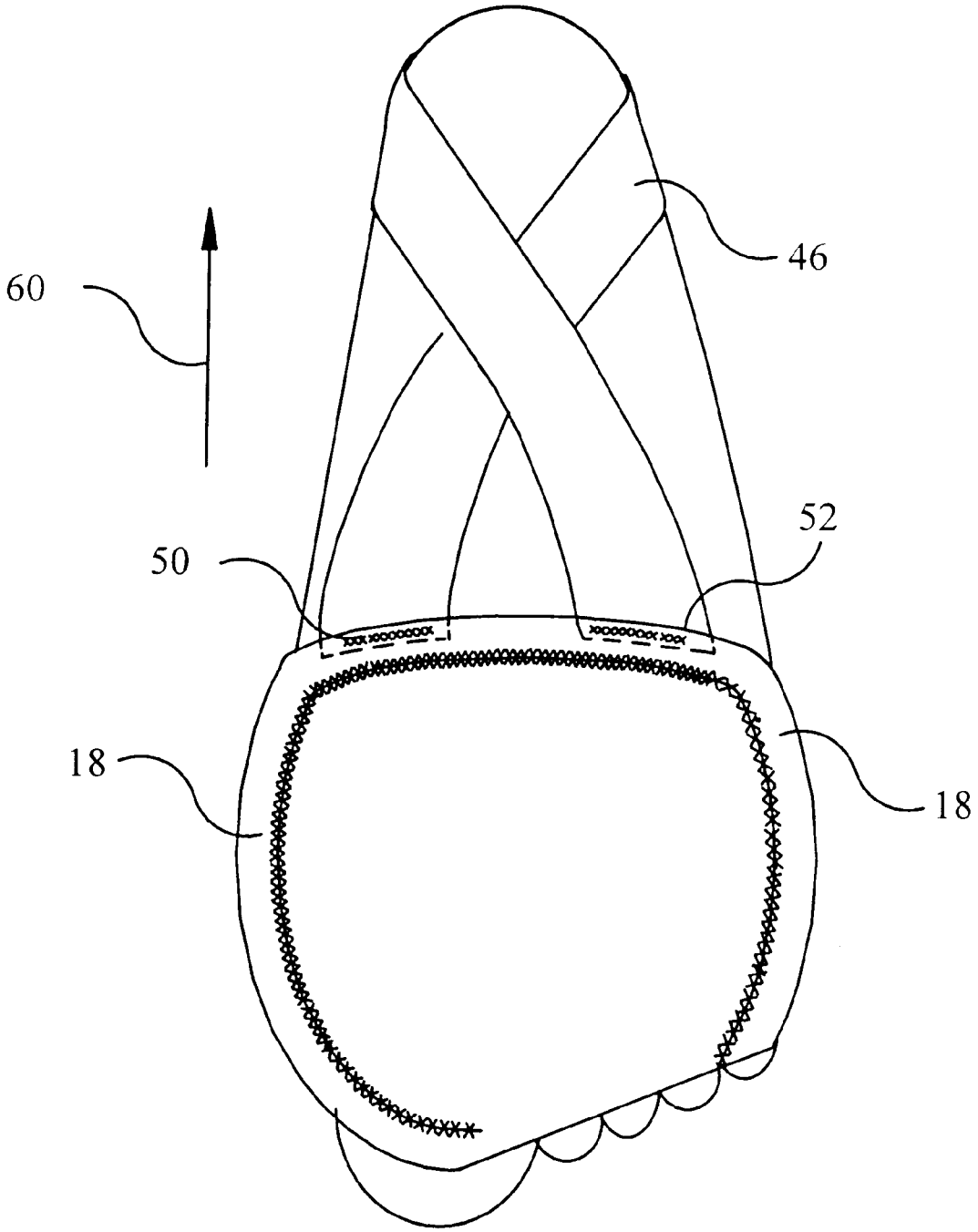
FIG. 8 is a bottom plane view of the present invention on an individual's foot.

In addition, as heel strap 46 is stretched in the direction of arrow 60 (as illustrated in FIG. 8) elastic band 18 is also stretched in the direction of arrow 60 at points 50 and 52. This stretching of elastic band 18 causes elastic band 18 to have a substantially flat profile in-between points 50 and 52 when protective foot covering 10 is worn on the dancer's foot. This stretching not only provides comfort but also provides support to be bottom of the dancer's foot.

Thus, the inventive foot covering of the present invention provides durable yet lightweight protection to the ball of the dancer's foot.

Referring now to FIGS. 5–8, as protective foot covering can is placed on the dancers foot and elastic straps 26, 34, and 42 can be manipulated by the user to find a positioned most comfortable for use while dancing.

Referring in particular to FIG. 6, second elastic strap 34, and straps 42 can be manipulated to be placed within the dancers toes. Alternatively and referring in particular to FIGS. 5 and 7, second elastic strap 34 and strap 42 can be manipulated to be placed over the toes of a dancer. In the preferred embodiment, straps 34 and 42 are positioned in-between the dancer's toes to provide a positioning of protective foot cover 10 which is most supportive and comfortable.

Moreover, protective foot covering 10, can be worn over a bare foot or over a foot having a stocking on it (as illustrated in FIG. 5).

Therefore, it is one aspect of the present invention to provide a protective foot covering that can be manipulated to suit the requirements of a particular user.

Figure 9:
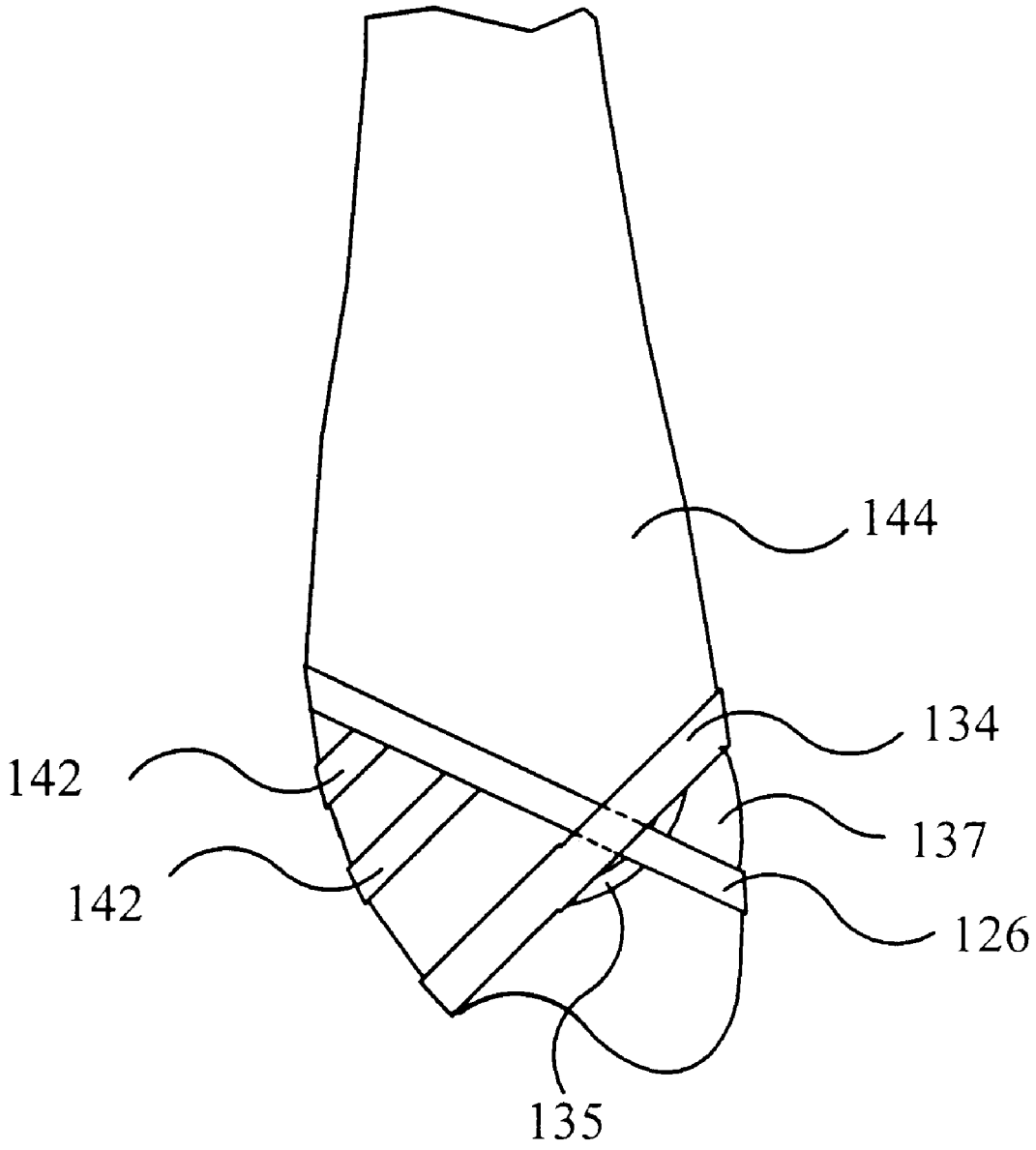
FIG. 9 is a top plane view of an alternative embodiment of the present invention.

Referring now to FIGS. 9, an alternative embodiment of the present invention is illustrated. In this embodiment, components and/or parts performing analogous or similar functions are numbered in multiples of 100. Here a similar foot covering 110 has an adjustment strap or connector 135 to adjust the point of intersect between strap 126 and 134. This adjustable positioning allows a user to manipulate the placement of straps 126 and 134 for comfort or to accommodate the bunion 137 of a dancer's foot.

Alternatively, adjustment strap or connector 135 may be replaced or supplemented by an alternative securement device such as a velcro strap or buckle as illustrated by the dashed lines in FIG. 9. Adjustment strap 135 may be secured to either strap 126 and 134 or both.

While an illustrative embodiment of the invention has been described, various modifications will be obvious to those skilled in the art. Such modifications are within the spirit and scope of the present invention which is limited and defined only by the appended claims.

We claim:

1. An item of footwear which functions as a foot protector for a dancer's foot comprising:

a) a pad covering the ball of said dancer's foot;

b) an elastic member partially surrounding the periphery of said pad;

c) a plurality of other elastic members secured to said pad, said elastic member and each other, said other elastic members being configured, dimensioned and positioned to surround a portion of the toes and a portion of the metatarsus of said dancer's foot and to maintain said foot protector in contact with said dancer's foot; and d) an elastic heel strap connected to said elastic member, said elastic heel strap being configured, dimensioned and positioned to receive the heel portion of said dancer's foot and to maintain said foot protector in contact with said dancer's foot.

2. An item of footwear as in claim 1, wherein said elastic heel strap is neoprene.

3. An item of footwear as in claim 1, wherein said elastic heel strap is a neoprene type material having an elastic covering adhered its outer surfaces, said elastic coverings providing elasticity to said elastic heel strap.

4. An item of footwear as in claim 1, wherein said pad is leather.

5. An item of footwear as in claim 4, wherein said pad has an upper surface and a lower surface, said upper surface making contact with the ball of said dancer's foot and has lower coefficient of friction as said lower surface.

6. An item of footwear as in claim 1, wherein said elastic heel strap is configured, dimensioned and positioned to cross over itself at a cross over point and define a receiving area configured, dimensioned and positioned to receive the heel portion of said dancer's foot.

7. An item of footwear as in claim 1, wherein said elastic heel member is configured, dimensioned and positioned to define an upright wall around a portion of the periphery of said pad.

8. An item of footwear which functions as a foot protector for said dancer's foot comprising:

a) a pad covering a portion of the underside of said dancer's foot;

b) an elastic member partially surrounding the periphery of said pad and defining an elastic wall;

c) a first elastic strap secured to said elastic member at one end and said pad, said first elastic strap being configured, dimensioned and positioned to maintain said protective covering on said dancer's foot;

d) a second elastic strap secured to said elastic member at, said second elastic strap being configured, dimensioned and positioned to maintain said protective covering on a dancer's foot;

e) a pair of elastic straps each being secured to said elastic member at one end and said second elastic strap at their other ends, said pair of elastic straps being configured, dimensioned and positioned to maintain said protective covering on said dancer's foot and plurality of other elastic members secured said pad; and f) an elastic heel strap connected to said elastic member, said elastic heel strap being configured, dimensioned and positioned to receive the heel portion of said dancer's foot and to maintain said foot protector in contact with said dancer's foot.

* * * * *